US005479072A

United States Patent [19]

Dakin et al.

[11] Patent Number: 5,479,072

[45] Date of Patent: Dec. 26, 1995

[54] LOW MERCURY ARC DISCHARGE LAMP CONTAINING NEODYMIUM

[75] Inventors: James T. Dakin, Shaker Heights; Tommie Berry, Jr., East Cleveland; Mark E. Duffy, Shaker Heights; Timothy D. Russell, Cleveland Heights, all of Ohio

[73] Assignee: General Electric Company, Schenectady, N.Y.

[21] Appl. No.: 790,837

[22] Filed: Nov. 12, 1991

[51] Int. Cl.[6] ..... H01J 61/00

[52] U.S. Cl. ..... 313/638; 313/643

[58] Field of Search ..... 313/638, 643, 313/639

[56] References Cited

U.S. PATENT DOCUMENTS

| | | | |
|---|---|---|---|
| 4,206,387 | 6/1980 | Kramer et al. | 315/248 |
| 4,636,692 | 1/1987 | Lapatovich et al. | 313/638 X |
| 4,801,846 | 1/1989 | Kramer et al. | 313/641 |
| 4,810,938 | 3/1989 | Johnson et al. | 315/248 |
| 4,812,702 | 3/1989 | Johnson | 313/153 |
| 4,890,042 | 12/1989 | Witting | 315/248 |
| 4,959,584 | 9/1990 | Anderson | 313/160 |
| 4,972,120 | 11/1990 | Witting | 313/638 |
| 5,032,757 | 7/1991 | Witting | 313/44 |
| 5,032,762 | 7/1991 | Spacil et al. | 313/635 |
| 5,039,903 | 8/1991 | Farrall | 313/160 |

FOREIGN PATENT DOCUMENTS

| | | | |
|---|---|---|---|
| 95849 | 4/1991 | Japan | 313/638 |

*Primary Examiner*—Sandra L. O'Shea
*Attorney, Agent, or Firm*—Stanley C. Corwin

[57] ABSTRACT

A high intensity metal halide arc discharge lamp, such as an electrodeless lamp wherein RF energy is inductively coupled to the arc discharge, contains a halide of neodymium alone or in combination with other metals such as one or more rare earth metals, Na, Cs and is essentially mercury free (i.e., <1 mg per cc of arc chamber volume).

29 Claims, 2 Drawing Sheets

LOW MERCURY ARC DISCHARGE LAMP CONTAINING NEODYMIUM

BACKGROUND OF THE INVENTION

1. Field of the Invention

This invention relates to a low mercury arc discharge lamp containing a halide of neodymium. More particularly this invention relates to a high intensity, electrodeless arc discharge lamp wherein the arc tube contains an essentially mercury-free fill including a halide of neodymium.

2. Background of the Disclosure

High intensity electroded arc discharge lamps such as high pressure sodium lamps and metal halide lamps are well known and include a light-transmissive arc discharge chamber or tube hermetically sealed and enclosing within a pair of spaced apart electrodes and a suitable fill such as an inert starting gas and one or more ionizable metals or metal halides. Two of the major causes of lamp failure are sputtering of electrode material onto the lamp envelope and thermal and electrical stresses which result in electrode failure. More recently a new class of arc discharge lamps has been developed called electrodeless lamps. Such lamps have a light-transmissive, electrodeless arc chamber or tube generally shaped like a pillbox or slightly flattened sphere and containing a fill which comprises a suitable inert buffer gas and one or more metal halides. Radio frequency (RF) energy applied or coupled to the fill via capacitive or inductive coupling generates a light-emitting arc. In operation of such a lamp via inductive coupling, the arc tube or chamber acts as a single-turn secondary coil of a transformer and is surrounded by an RF energy excitation coil which acts as a primary coil. Various embodiments of such lamps are disclosed, for example, in U.S. Pat. Nos. 4,810,938; 4,890,042; 4,972,120; 4,959,584; 5,032,757; 5,032,762 and 5,039,903 all of which are assigned to the assignee of the present invention. Continuing research and development has been directed towards improving the color emitted by electrodeless arc discharge lamps while maintaining the relatively high color rendering index (CRI) and lamp efficacy exhibited by these lamps.

SUMMARY OF THE INVENTION

The present invention relates to an arc discharge lamp, particularly an electrodeless arc discharge lamp, having good color, efficacy and CRI wherein the arc chamber or tube contains an essentially mercury-free fill comprising a buffer gas and at least one halide of neodymium (Nd). Thus, the present invention relates to an arc discharge lamp and particularly an electrodeless arc discharge lamp comprising a light-transmissive arc chamber containing an arc-sustaining fill which is essentially mercury-free and which comprises a buffer gas and at least one halide of Nd, said lamp further including means for applying or coupling radio frequency energy to said fill to produce a light-emitting arc. It is understood of course that at least a portion of the Nd in the fill will be present in the arc and contribute to the emission spectrum during operation of the lamp.

By essentially mercury-free is meant that if mercury is present in the arc chamber, it will be present in an amount of less than 1 mg per cc of arc chamber volume. By buffer gas is meant a gas which does not adversely effect the operation of the lamp and which acts as a buffer to reduce metal transport from the arc to the wall of the arc chamber. In some embodiments, in addition to containing at least one halide of Nd, the fill will also contain a halide of one or more additional metals such as rare earth metal, sodium (Na), cesium (Cs), tin (Sn), etc. It should be understood that the foregoing list of metals is meant to be illustrative, but not limiting to the practice of the invention.

DETAILED DESCRIPTION

Figure 1:
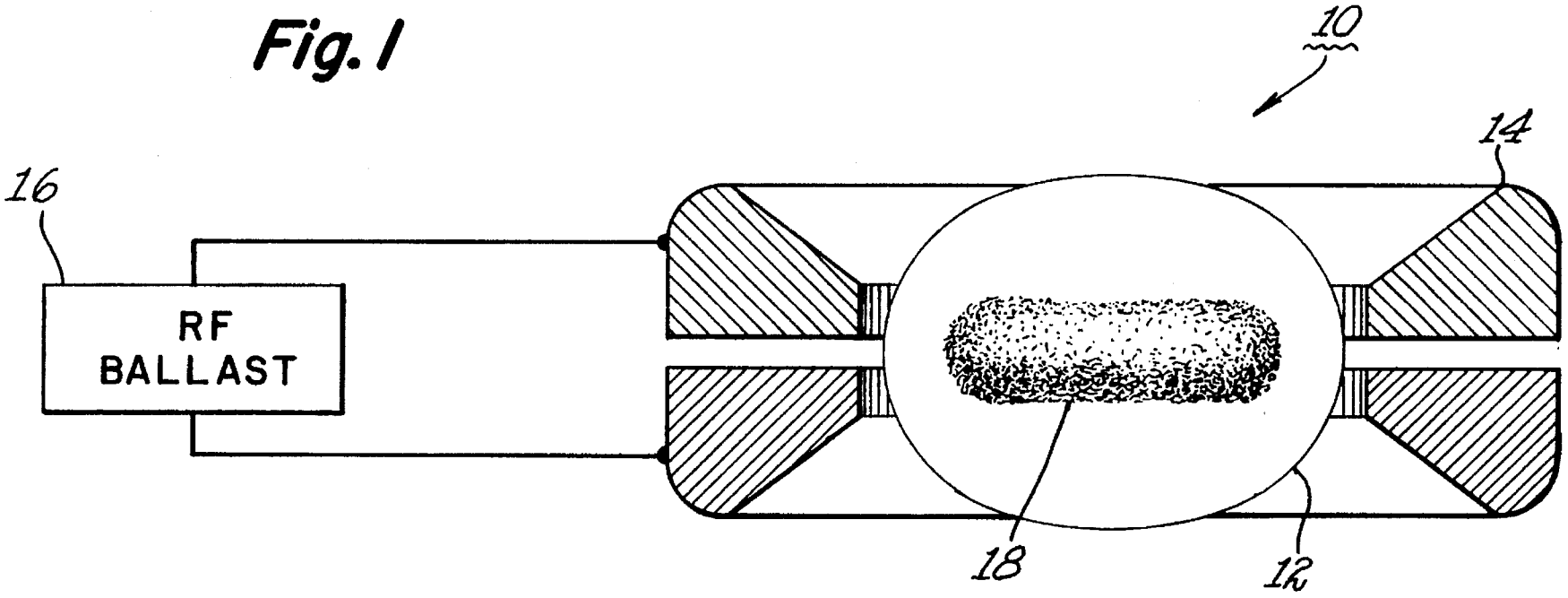
FIG. 1 schematically illustrates an electrodeless arc discharge lamp useful in the practice of the invention.

FIG. 1 schematically illustrates a high-intensity, metal halide electrodeless arc discharge lamp 10 of the present invention which includes an arc chamber 12 in the general shape of an ellipsoid which enables nearly isothermal operation. Other arc chamber shapes such as generally spherical, ellipsoidal, etc., may be used provided that such shape permits the formation of an arc within the arc chamber. Electrical power in the form of an RF signal is applied to the arc chamber by an excitation coil 14 disposed about arc chamber 12 and connected in the embodiment shown to an RF power supply or ballast 16. In this embodiment the RF power is inductively coupled to the arc. Excitation coil 14 is illustrated as a two-turn coil having the configuration shown wherein the overall shape of the excitation coil is generally that of a surface formed by rotating a bilaterally symmetrical trapezoid about a coil center line situated in the same plane as the trapezoid, but which line does not intersect the trapezoid. Such a coil configuration results in very high efficiency and causes only minimal blockage of light from the lamp. This particular coil configuration is described in greater detail in U.S. Pat. No. 5,039,903 the disclosures of which are incorporated herein by reference. However, other suitable coil configurations may be used, such as that described in commonly assigned J. M. Anderson U.S. Pat. No. 4,812,702, issued Mar. 14, 1989, which patent is hereby incorporated by reference. In particular, the Anderson patent describes a coil having six turns which are arranged to have a substantially V-shaped cross section on each side of a coil center line. Still another suitable excitation coil may be of solenoidal shape, for example. The choice of coil configuration, location and shape will be determined by the practitioner.

In operation, RF current in coil 14 results in a time-varying magnetic field which produces within arc tube or chamber 12 an electric field that closes upon itself. Current flows through the fill within chamber 12 as a result of this solenoidal electric field, producing a toroidal arc discharge 18 in chamber 12. The operation of an electrodeless high intensity discharge lamp is described in the Johnson et al U.S. Pat. No. 4,810,938. Suitable operating frequencies for the RF power supply range from 0.1 megahertz to 300 megahertz.

Arc chamber 12 is made of a suitable electrically insulative, light-transmissive material such as fused quartz made from high purity silica sand, synthetic quartz, a high temperature glass or an optically transparent or translucent ceramic such as sapphire or polycrystalline alumina. The material of choice for these arc chambers at the present time is fused quartz having a purity of greater than 99% $SiO_2$.

The arc chamber in lamps of the present invention will be essentially mercury-free and will have hermetically sealed within it a fill comprising a buffer gas and at least one halide of Nd. As set forth above, by essentially mercury-free is meant that mercury may be present in the arc chamber in an amount less than 1 mg per cc of arc chamber volume.

Preferably the mercury, if present in the arc chamber, will be present in an amount of less than 0.3 mg per cc and more preferably less than 0.2 mg per cc. This is substantially less than the amount of mercury present in the arc chambers of both electrodeless and electroded arc discharge lamps of the prior art wherein the mercury is present in the arc chamber in amounts of up to 40 mg per cc or more. The presence of mercury in the arc chamber of lamps of the present invention in amounts greater than that set forth above will reduce the lamp efficacy or affect the color of the light emitted by the arc. In electrodeless lamps the presence of mercury will also increase coil losses which further reduces lamp efficacy.

As set forth above, the arc chamber must contain at least one halide of Nd and in some embodiments will also contain at least one halide of one or more additional metals of which illustrative, but non-limiting examples include, Na, Cs, Sn, the rare earth metals such as cerium (Ce), praseodymium (Pr), dysprosium (Dy), holmium (Ho), thulium (Tm), etc. Sodium and cesium have been found to have a stabilizing effect on the arc discharge. Neodymium itself provides a relatively high color temperature of about 6000° K. which exhibits a cool color toward the blue portion of the visible light spectrum. Sodium exhibits a warmer, lower color temperature more towards the yellow portion of the spectrum, but is slowly depleted from the arc chamber by diffusion. Cesium doesn't effect the color temperature. Hence, if a halide of Cs is used with the Nd halide and a warmer color temperature is desired, one or more additional metal halides exhibiting a warm color temperature must be employed. The choice of additional metal halides is left to the practitioner. The arc chamber must also be hot enough during operation of the lamp to insure that the Nd and any other metal used in the fill to achieve the desired color and efficacy is a constituent of the arc. In general, this means that the coolest portion of the arc chamber will be over 500° C.

Those skilled in the art know that an arc chamber can be designed to be either dose limited or vapor pressure limited or a combination of dose and vapor pressure limited. In a dose limited arc chamber all of the metal halide present is vaporized during operation of the arc. A vapor pressure limited design requires a portion of each metal halide to be present as condensate during operation of the arc. Thus, in a vapor limited lamp design, each metal halide in the arc chamber will be present in an amount in excess of that required to achieve the desired color and efficacy so that a portion of each metal halide employed will be present as condensate during operation of the lamp.

Preferred halides include iodides, chlorides, bromides and mixtures thereof, with iodides being preferred. Thus, in one embodiment metal iodides are preferred for use in the lamps of this invention. The arc chamber must contain a buffer gas which is inert to the extent that it does not adversely effect operation of the lamp and which acts as a buffer to reduce metal transport from the arc to the arc chamber wall and which also preferably aids in starting the arc. Noble gases are suitable buffer gases. Although any noble gas will work to some extent, preferred gases are krypton (Kr), xenon (Xe), argon (Ar) and mixtures thereof, with Kr being particularly preferred. Although neon (Ne) could be used, it will slowly diffuse through the quartz wall of the arc chamber which will lower lamp efficacy and it also emits a bluish color when ionized. Helium (He) could also be employed, but is even more prone to diffusing through the wall of a quartz arc chamber. Furthermore, He has a higher thermal conductivity than Ne, Ar, Kr or Xe and therefore higher thermal conduction loss. The pressure of the gas in the arc chamber will be above 50 torr and more preferably above 100 torr at room temperature.

The invention will be further understood by reference to the examples set forth below.

EXAMPLES

In all of the examples the lamp was as illustrated in FIG. 1 employing a fused quartz arc chamber whose dimensions were 26 mm OD and 19 mm high with a wall thickness of approximately 1 mm. During operation the coldest portion of the arc chamber was about 900° C. In all cases the metal halides were iodides, the arc chamber contained Kr at a pressure of 250 torr at room temperature in addition to the metal iodide and the Nd vapor pressure was sufficiently high for the Nd radiation to contribute more than 10% of the total visible radiation emitted by the arc. None of the arc chambers contained mercury. An RF coil as shown in FIG. 1 operating at 13.56 MHz furnished from 200 to 400 watts of power to the arc. Finally, in all cases each metal halide in the arc chamber was present in an amount in excess of that required to achieve the desired color and efficacy, which insured that a portion thereof was present as condensate during operation of the lamp.

| Example | Metal Halide Molar Composition | Halide Dose (mg) | Disch. Power (W) | Arc Eff. (lm/W) | Color Rend. (CRI) | Color Temp. (K) | CIE Color Coordinates (x) | (y) |
|---|---|---|---|---|---|---|---|---|
| A | Nd:Cs = 2:1 | 44 | 215 | 74 | 82 | 8400 | 0.28 | 0.33 |
| B | " | " | 312 | 127 | 81 | 5700 | 0.33 | 0.39 |
| C | " | " | 396 | 112 | 79 | 4900 | 0.36 | 0.43 |
| D | Na:Nd:Cs = 5:1:1 | 21 | 257 | 116 | 32 | 3500 | 0.40 | 0.39 |
| E | Na:Nd:Sn = 5:3:1 | 38 | 214 | 50 | 62 | 4100 | 0.38 | 0.39 |
| F | Na:Nd = 1:1 | 38 | 325 | 129 | — | 4800 | 0.36 | 0.41 |
| G | Na:Nd = 5:1 | 17 | 295 | 151 | 55 | 3900 | 0.39 | 0.40 |
| H | Na:Nd = 9:1 | 14 | 295 | 152 | 41 | 3200 | 0.42 | 0.40 |
| I | Nd | 35 | 260 | 102 | 81 | 6900 | 0.30 | 0.37 |
| J | " | " | 303 | 120 | — | 6300 | 0.31 | 0.38 |
| K | " | " | 347 | 129 | — | 5900 | 0.32 | 0.39 |

Examples A–C

Figure 2:
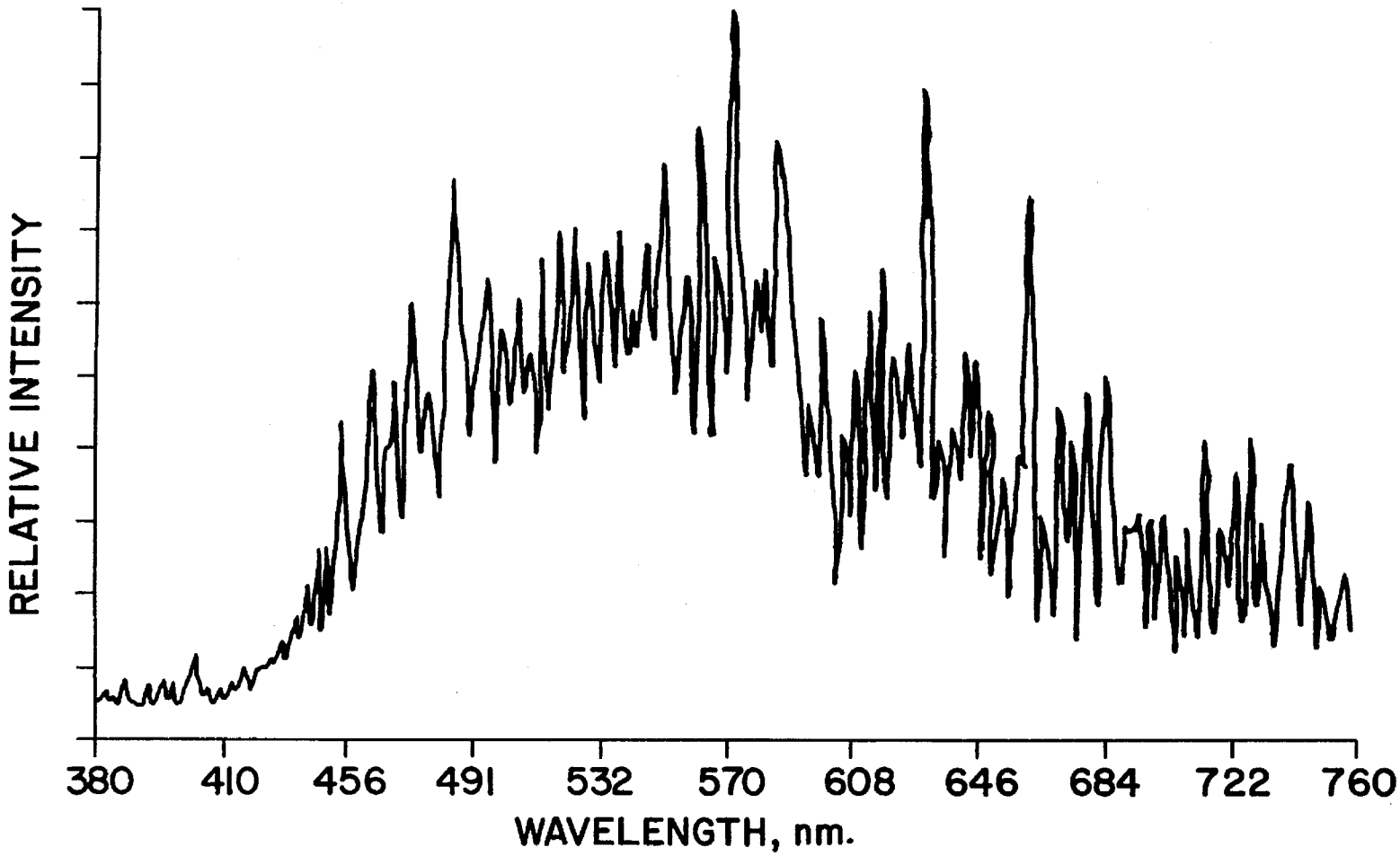
FIG. 2 is a graph of intensity versus wavelength illustrating the visible color spectrum of an electrodeless lamp according to the invention.

In these three examples the metal halide in the arc chamber was 44 mg of a 2:1 molar mixture of $NdI_3$:CsI and the arc chamber was operated at different power levels. FIG. 2 is a graph of the visible color spectrum obtained for Example C. The spectrum is substantially continuous from about 410 to 760 nm with most of the light emitted from about 490 to 604 nm which indicates high efficacy (112 lm/W in this case) and good color rendering (79 CRI in this case).

Examples D–E

These two examples illustrate the use of ternary halides in lamps of the invention, including NaI, $NdI_3$ and a third iodide which was of Cs or Sn. In Example D the third metal was Cs which served to fatten and stabilize the arc. In Example E the third metal was Sn which filled out the spectrum and increased the color rendering of the emitted light.

Examples F–H

These are examples of three different molar ratios of NaI and $NdI_3$. The three separate arc chambers were operated at about the same power in all three examples. Increasing the Na:Nd molar ratio resulted in warmer color (lower color temperature).

Examples I–K

In these examples the arc chamber contained $NdI_3$ as the metal halide and the arc chamber was operated at the three different power levels shown in the Table. The data show that variation in the power level produced less variation in color than was obtained for a similar power variation in Examples A, B and C, where a second halide was present.

What is claimed is:

1. A light-transmissive arc chamber for an arc discharge lamp containing a fill for initiating and sustaining a torus-shaped arc discharge wherein said fill is essentially free of mercury and comprises a buffer gas and a halide of Nd.

2. The arc chamber of claim 1 wherein said buffer gas comprises at least one noble gas.

3. The arc chamber of claim 2 wherein said buffer gas is selected from the group consisting essentially of Kr, Xe, Ar and mixture thereof.

4. The arc chamber of claim 3 wherein mercury, if present, is present in an amount less than 1 mg/cc of arc chamber volume.

5. The arc chamber of claim 4 wherein said halide is selected from the group consisting essentially of iodide, bromide, chloride and mixture thereof.

6. The arc chamber of claim 5 additionally containing halide of a metal selected from the group consisting essentially of Na, Cs and mixture thereof.

7. The arc chamber of claim 5 containing a halide of at least one additional rare earth metal.

8. The arc chamber of claim 5 wherein mercury, if present, is present in an amount less than 0.3 mg/cc of arc chamber volume.

9. The arc chamber of claim 8 wherein mercury, if present, is present in an amount less than 0.2 mg/cc of arc chamber volume.

10. The arc chamber of claim 9 containing a halide of at least one additional rare earth metal.

11. A metal halide arc discharge lamp comprising (i) a light-transmissive arc chamber in which is disposed an arc-sustaining fill essentially free of mercury and which comprises a buffer gas and a halide Nd, and (ii) means for applying electrical energy to said fill to produce a light-emitting, torus-shaped arc.

12. The lamp of claim 11 wherein said buffer gas comprises at least one noble gas.

13. The lamp of claim 12 wherein said halide is selected from the group consisting essentially of iodide, bromide, chloride and mixture thereof and said buffer gas is selected from the group consisting essentially of Kr, Xe, Ar and mixture thereof.

14. The lamp of claim 13 wherein said arc chamber also contains a halide of a metal selected from the group consisting essentially of Na, Cs, at least one additional rare earth metal and mixture thereof.

15. The lamp of claim 14 wherein said mercury, if present in said arc chamber, is present in an amount less than 1 mg per cc of arc chamber volume.

16. The lamp of claim 15 wherein said mercury, if present in said arc chamber, is present in an amount of less than 0.3 mg per cc of arc chamber volume and wherein the coldest portion of said arc chamber is greater than 500° C. during operation of said lamp.

17. An electrodeless metal halide arc discharge lamp having a hermetically sealed, vitreous, light-transmissive arc chamber in which is disposed an arc-sustaining fill essentially free of mercury and which comprises a buffer gas and a halide of neodymium, said arc chamber having its coldest portion at a temperature greater than 500° C. during operation of said lamp and said lamp further including means for applying RF energy to said fill to produce a light-emitting, torus-shaped arc.

18. The lamp of claim 17 wherein said buffer gas comprises at least one noble gas.

19. The lamp of claim 18 wherein said buffer gas is selected from the group consisting essentially of Kr, Xe, Ar and mixture thereof and wherein said halide is selected from the group consisting essentially of iodide, bromide, chloride and mixture thereof.

20. The lamp of claim 19 wherein said halide includes an iodide.

21. The lamp of claim 19 wherein said arc chamber also contains a halide of Na, Cs or mixture thereof.

22. The lamp of claim 19 wherein said arc chamber contains a halide of at least one additional rare earth metal.

23. The lamp of claim 22 wherein said mercury, if present, is present in an amount less than 1 mg per cc of arc chamber volume.

24. An electrodeless, metal halide arc discharge lamp having a hermetically sealed, light-transmissive fused quartz arc chamber having disposed therein an arc-sustaining fill essentially free of mercury and comprising (i) a buffer gas at a pressure of at least 50 torr selected from the group consisting essentially of Kr, Xe, Ar and mixture thereof and (ii) a halide of Nd, said lamp further including means for applying RF energy to said fill to produce a light-emitting, torus-shaped arc.

25. The lamp of claim 24 wherein said halide is selected from the group consisting essentially of an iodide, bromide, chloride and mixture thereof.

26. The lamp of claim 25 wherein the coldest portion of said arc chamber is greater than 500° C. during operation of said lamp.

27. The lamp of claim 26 wherein mercury, if present in said lamp, is present in an amount less than 1 mg per cc of arc chamber volume.

28. The lamp of claim 27 wherein said RF energy is inductively coupled to said arc.

29. The lamp of claim 28 wherein neodymium iodide is present in said arc chamber.

* * * * *